US012285071B2

(12) United States Patent
Ketterer et al.

(10) Patent No.: US 12,285,071 B2
(45) Date of Patent: Apr. 29, 2025

(54) SYSTEMS AND METHODS FOR PROVIDING AN ASSEMBLY FOR RELEASABLY CONNECTING AN INNER HELMET AND OUTER HELMET SHELL

(71) Applicant: MSA Technology, LLC, Cranberry Township, PA (US)

(72) Inventors: Kevin R. Ketterer, Portersville, PA (US); David J. Losos, Evans City, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 0 days.

(21) Appl. No.: 17/715,338

(22) Filed: Apr. 7, 2022

(65) Prior Publication Data

US 2023/0320452 A1 Oct. 12, 2023

(51) Int. Cl.

| | |
|---|---|
| ***A42B 3/32*** | (2006.01) |
| ***A42B 3/12*** | (2006.01) |
| ***A42B 3/30*** | (2006.01) |

(52) U.S. Cl.

CPC ..... *A42B 3/328* (2013.01); *A42B 3/127* (2013.01); *A42B 3/30* (2013.01)

(58) Field of Classification Search

CPC ..... A42B 3/06; A42B 3/063; A42B 3/064; A42B 3/067; A42B 3/068; A42B 3/127; A42B 3/14; A42B 3/142; A42B 3/32; A42B 3/328; A42B 3/0406; A42B 3/0446

USPC ..... 2/422

See application file for complete search history.

(56) References Cited

U.S. PATENT DOCUMENTS

| | | | | | |
|---|---|---|---|---|---|
| 3,548,411 | A | * | 12/1970 | Barstow | A42B 3/228 351/44 |
| 4,161,806 | A | * | 7/1979 | Hennisse | A41F 1/006 24/594.11 |
| 4,449,787 | A | * | 5/1984 | Burbo | A42B 3/042 359/410 |
| 4,964,178 | A | * | 10/1990 | Giancarlo | A42B 3/281 2/171.7 |
| 5,044,016 | A | | 9/1991 | Coombs | |
| 5,658,065 | A | * | 8/1997 | Jamieson | A42B 3/04 2/6.2 |
| 5,898,949 | A | | 5/1999 | Barthold et al. | |

(Continued)

OTHER PUBLICATIONS

Mercanti, Saris. "Strap-ID makes your medical information easily accessible to first responders". bikerumor.com. May 9, 2014. https://bikerumor.com/strap-id-makes-your-medical-information-easily-accessible-to-first-responders/. Accessed Jan. 10, 2024. (Year: 2014).*

(Continued)

*Primary Examiner* — Jameson D Collier
*Assistant Examiner* — Matthew R Marchewka
(74) *Attorney, Agent, or Firm* — Jones Day

(57) ABSTRACT

Systems and methods are provided for a helmet shell mounting assembly. A system includes a mounting component and a locking slider configured to interface with the mounting component when the locking slider is in an engaged position to secure an outer helmet shell to an inner helmet. In another embodiment, the system also includes an anchor that is configured to pass through the outer helmet shell via a through hole and be received by the mounting component, and the locking slider is configured to retain the anchor within the mounting component when the locking slider is in the engaged position.

18 Claims, 10 Drawing Sheets

(56) References Cited

U.S. PATENT DOCUMENTS

| | | | | |
|---|---|---|---|---|
| 6,108,824 | A * | 8/2000 | Fournier | A42B 3/324 2/418 |
| 6,138,283 | A * | 10/2000 | Kress | A42B 3/328 2/424 |
| 7,096,513 | B1 * | 8/2006 | Kress | A42B 3/328 2/425 |
| 2004/0163160 | A1 * | 8/2004 | Oleson | A42B 3/14 2/410 |
| 2011/0068918 | A1 * | 3/2011 | Cummings | G08B 21/0461 340/10.1 |
| 2011/0072548 | A1 | 3/2011 | Hersick et al. | |
| 2011/0188236 | A1 * | 8/2011 | Eichelberger | F21L 4/00 362/191 |
| 2012/0216338 | A1 * | 8/2012 | Arrouart | A42B 3/322 2/410 |
| 2014/0283346 | A1 * | 9/2014 | Mitchell, Jr. | A44B 11/16 24/68 E |
| 2017/0245578 | A1 | 8/2017 | Xiong et al. | |
| 2018/0042330 | A1 * | 2/2018 | Wu | A42B 3/085 |
| 2018/0325202 | A1 * | 11/2018 | McAllister | A42B 3/06 |
| 2019/0350291 | A1 * | 11/2019 | Maldonado | F21V 21/084 |
| 2020/0154811 | A1 * | 5/2020 | Hyma | A42B 3/042 |
| 2021/0076769 | A1 | 3/2021 | Kirshon | |
| 2021/0112391 | A1 * | 5/2021 | Livano | H04M 9/02 |
| 2021/0315302 | A1 * | 10/2021 | Philibert | A42B 3/04 |
| 2021/0330018 | A1 * | 10/2021 | Yarlagadda | A42B 3/064 |
| 2021/0345694 | A1 * | 11/2021 | Volk | A41D 13/1161 |
| 2022/0039501 | A1 * | 2/2022 | Maltz | A42B 3/04 |

OTHER PUBLICATIONS

Patent Cooperation Treaty; PCT/US2023/065347; International Search Report and Written Opinion of the International Searching Authority; Aug. 4, 2023.

* cited by examiner

SYSTEMS AND METHODS FOR PROVIDING AN ASSEMBLY FOR RELEASABLY CONNECTING AN INNER HELMET AND OUTER HELMET SHELL

BACKGROUND

Helmets are a common form of protective gear for the head, protecting the human brain. Helmets have a wide range of applications ranging from recreational, to construction, to combat, to safety and rescue (e.g., full brimmed fire helmets). Helmets are often constructed in portions, where an inner helmet interfaces with a wearer's head and provides some level of protection, such as via padding applied to the outside of the inner portion to provide shock absorption. An outer shell, often having a hard outward facing surface provides additional protection, such as providing further shock absorption as well as helmet penetration prevention.

SUMMARY

Systems and methods are provided for a helmet shell mounting assembly. A system includes a mounting component and a locking slider configured to interface with the mounting component when in an engaged position to secure an outer helmet shell to an inner helmet.

In another example, a method of interfacing an outer helmet shell to an inner helmet includes threading an anchor through a through hole of an outer helmet shell into a mounting component connected to an inner helmet. A locking slider is slid into the mounting component into an engaged position to secure a portion of the anchor within the mounting component.

DETAILED DESCRIPTION

Figure 1:
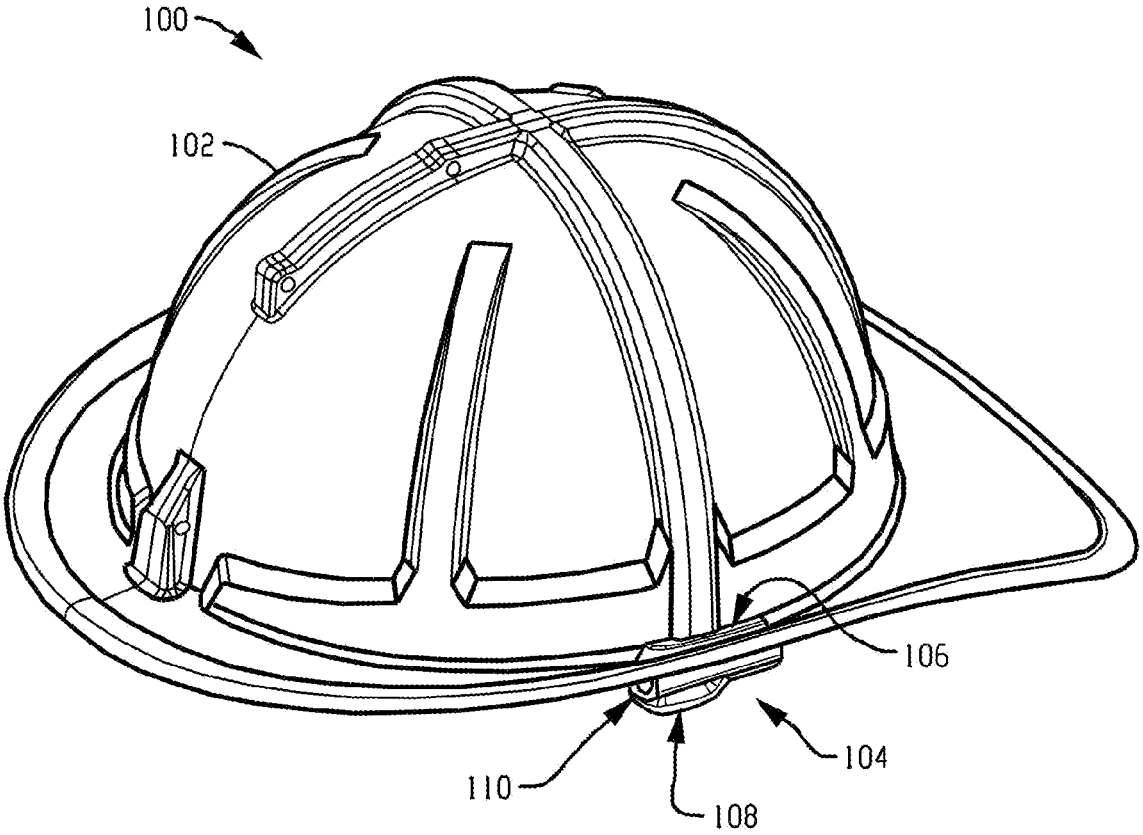
FIG. 1 is a diagram depicting a full brimmed fire helmet that includes a helmet shell mounting assembly.

The multi-layer implementation of helmets described above may ease in the manufacturing of helmets, where a hard outer shell can be manufactured separately from an inner helmet that may optimally be made from wholly different materials and be subjected to disparate manufacturing processes. For example, the inner helmet may be fabricated using materials and features designed to provide a snug and comfortable fit on the interior, while having a shock absorbing material (e.g., Styrofoam, air bladders, vinyl nitryl foam, expanded polypropalene foam) applied to the outer surface of the inner helmet. The outer helmet shell may then be made of a rigid or penetration preventative material, such as KEVLAR® (i.e. para-aramid fiber), carbon fiber, polycarbonate, molded plastics, composite materials, or combinations thereof.

While a multi-layer implementation provides certain advantages, mechanisms for connecting an inner helmet to an outer helmet shell may be cumbersome (e.g., brackets and screws), such that disconnecting an outer helmet shell from an inner helmet is time consuming. This can present an inconvenience during maintenance activities, such as cleaning and inspection. Difficulty in separating an outer helmet shell from an inner helmet can also present a safety issue in some instances. For example, when a wearer is injured (e.g., a head or neck injury), it may be necessary to remove the outer helmet shell for back-boarding the wearer, while leaving the inner helmet in place so as to limit movement of sensitive body structures. It may also be desirable to remove an outer helmet shell when a wearer is trapped or needing to ingress into or egress out of a confined space. Slow and complex disconnection procedures can significantly hamper safety in instances where time is of the essence.

Systems and methods provided herein, in embodiments, provide simple and fast connection and disconnection of a helmet inner helmet and an outer helmet shell. Increasing ease of cleaning, inspecting, and other servicing of helmets can increase health and safety of the wearers. Enabling mechanisms for fast disconnecting of an outer helmet shell from an inner helmet can also provide health and safety benefits in certain off-nominal scenarios (e.g., during a rescue operation, escaping an entrapment scenario).

Certain systems and methods herein may further enhance safety by providing designed separation of an outer helmet shell from an inner helmet based on the helmet being subjected to greater than a threshold level of force (e.g., greater than a threshold tensile load). In certain scenarios (e.g., a wearer being thrown from a maritime vessel at height, confined space operations), an intact helmet with a brim may contribute to injury of a wearer. During these scenarios, significant tensile and torsional impact forces may be imparted on the head and neck of the wearer (e.g., due to the wide brim of a fire-fighter helmet). An intended separation of the wide brimmed outer helmet shell from internal helmet components provides benefits that may include: providing relief from significant tensile and torsional forces; providing retention of some, albeit reduced, level of head protection for the end user, and releasing restrictive or otherwise encumbering component from the wearer, enabling rapid egress or extrication.

Embodiments of systems and methods described herein provide a mechanical interface between an outer helmet shell element and an internal helmet (e.g., a foam/plastic liner element) that may allow for intentional separation of said components under certain conditions (e.g., when subjected to a prescribed load which exceeds product certification requirements, upon actuation of a disengagement mechanism). In embodiments, the connection/disconnection assembly provides these capabilities using minimal components (e.g., few, if any loose components, such as screws), reducing the possibility of component loss or incorrect reassembly and facilitating more frequent cleaning and maintenance.

FIG. 1 is a diagram depicting a full brimmed fire helmet that includes a helmet shell mounting assembly. The helmet 100 includes an outer helmet shell 102 that in this example takes the form of a full brimmed fire helmet. The outer helmet shell 102 is secured to an inner helmet, not shown in FIG. 1. That connection is facilitated by one or more (1, 2, 3, 4, or more) mounting assemblies 104 (e.g., one on each side of the helmet). As illustrated further herein, an example mounting assembly includes an anchor 106 that includes a retention portion (visible in FIG. 1) and an extending portion (not visible in FIG. 1) that passes through the outer helmet shell 102 via one or more through holes, where the extending portion is received by a mounting portion 108, which may take the form of a structure integrated with the inner helmet (e.g., a plastic structure molded with other structure of the inner helmet). A locking slider 110 is configured to slide into the mounting portion 108 such that it retains the extending portion of the anchor 106 within the mounting portion 108 when the locking slider is in the engaged position, as it is in FIG. 1.

Figure 2:
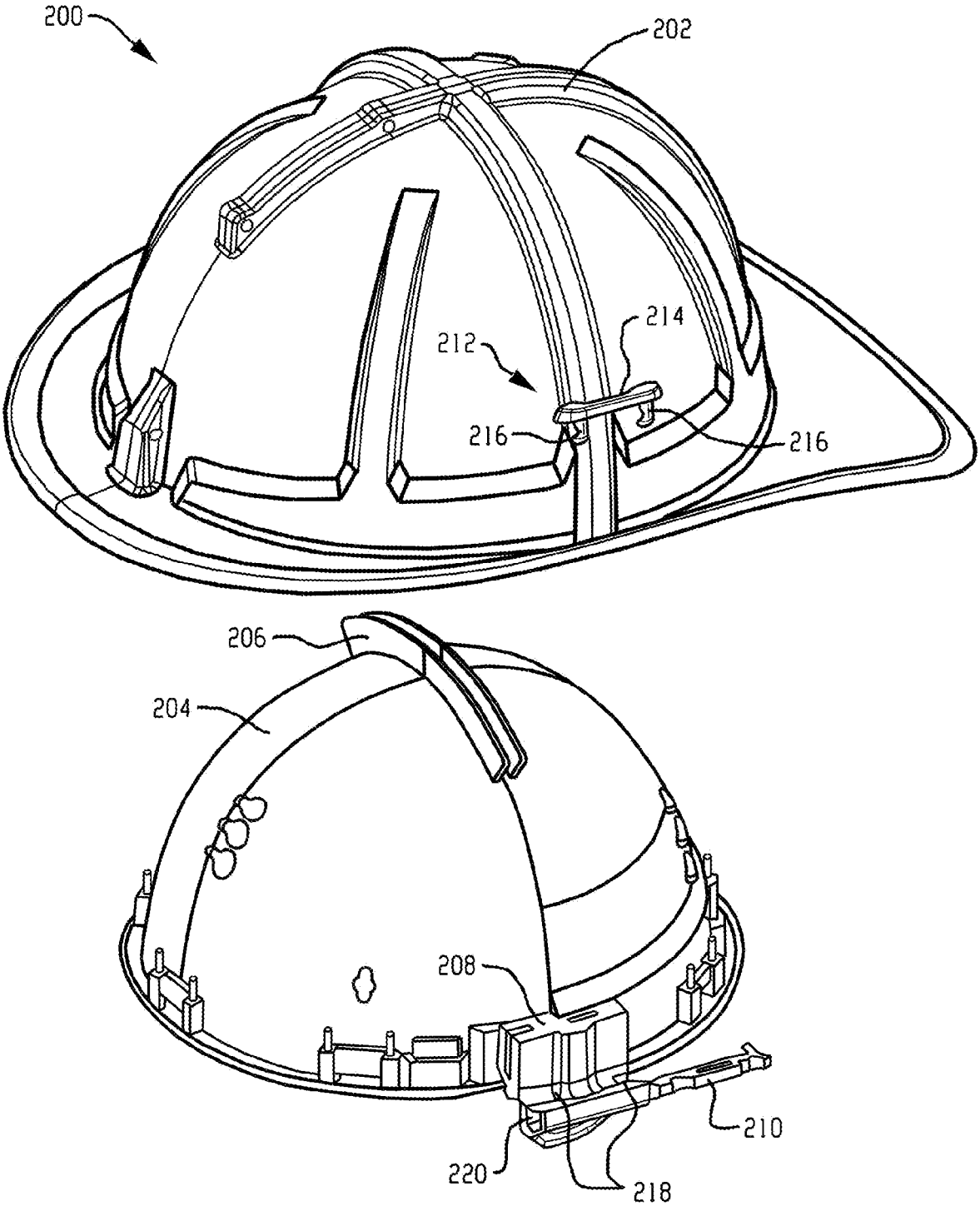
FIG. 2 is a diagram illustrating a helmet shell mounting assembly that secures an outer helmet shell to an inner helmet.

FIG. 2 is a diagram illustrating a helmet shell mounting assembly that secures an outer helmet shell to an inner helmet. The helmet 200, deconstructed in FIG. 2, includes an outer helmet shell 202 and an inner helmet 204. In the example of FIG. 2, the inner helmet is formed of a first material and includes a spacer at 206 for providing some shock absorption between the inner helmet 204 and the outer helmet shell 202. In embodiments, a layer of shock absorbing materials may be applied to the outside of the inner helmet 204 (e.g., in conjunction with spacer 206, in place of spacer 206) to provide spacing and shock absorption. The embodiment of FIG. 2 includes a helmet shell mounting assembly that includes a mounting component 208. The mounting assembly further includes a locking slider 210. The locking slider 210 is configured to interface with the mounting component 208 when in an engaged position (locking slider 210 shown in a disengaged position in FIG. 2) to secure the outer helmet shell 202 to the inner helmet 204.

The example of FIG. 2 further illustrates an anchor 212 that, in embodiments, facilitates securing of the outer helmet shell 202 to the inner helmet 204 using the mounting assembly 208, 210. The anchor 212 includes a retention portion 214 and one or more extending portions 216. The extending portions 216 of the anchor are configured to pass through the outer helmet shell 202 via through holes (not visible in FIG. 2). The extending portions 216 are configured to be received by the mounting portion 208 at 218, where the locking slider 210 is configured to retain the extending portions 216 of the anchor within the mounting portion 218 when the locking slider 210 is slid into the engaged position (e.g., into channel 220 of the mounting component 208). The example of FIG. 2 includes an anchor having two extending portions 216. Other embodiments may include a greater or fewer number of extending portions 216.

In embodiments, the locking slider 210 may be fully extractable from the channel 220, such that it becomes a loose component. In other embodiments, the locking slider 210 may include a retention mechanism, such as a tab that is configured to catch on a surface within the channel 220 such that the locking slider 210 is not easily extractable from the 220. In other embodiments, the locking slider 210 may be retained via a tether or otherwise connected to the inner helmet 204 or the mounting portion 208 to reduce a count of loose components.

Figure 3:
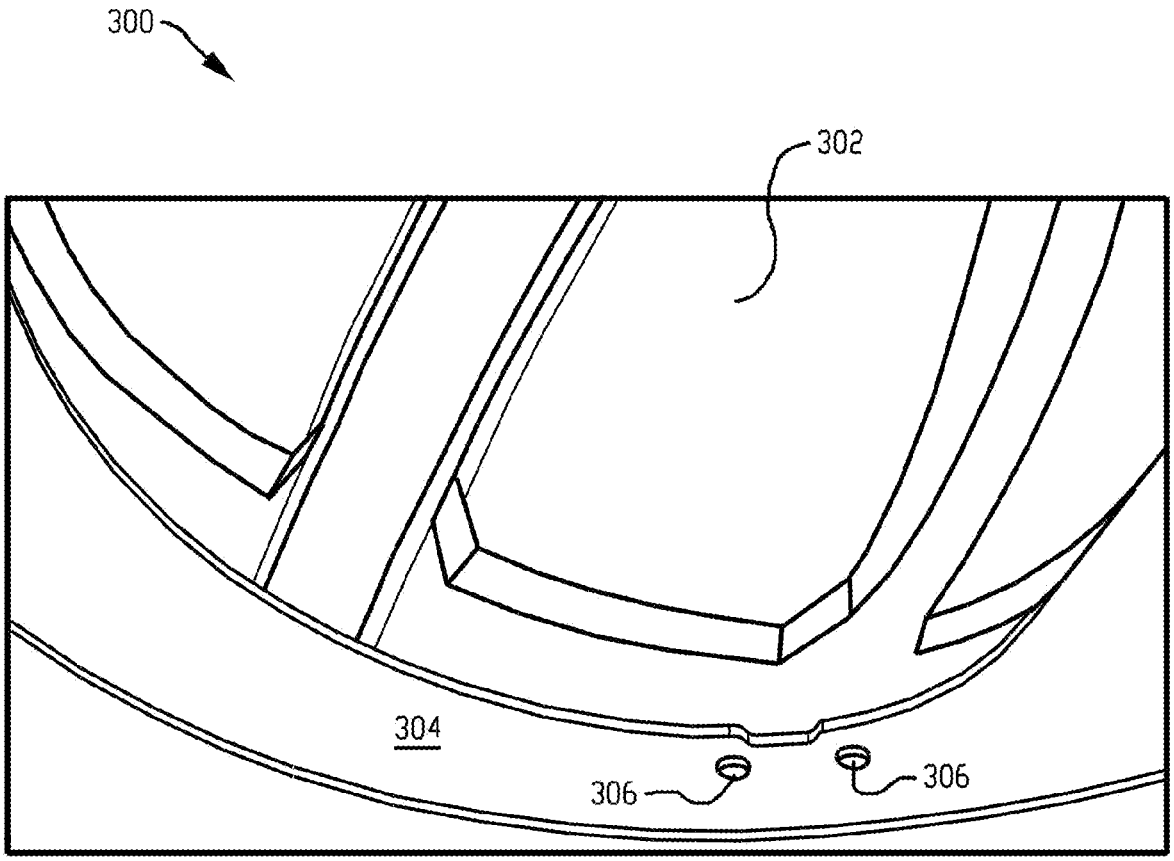
FIG. 3 is a diagram depicting example through holes of an outer helmet shell.

FIG. 3 is a diagram depicting example through holes of an outer helmet shell. The helmet 300 includes an outer helmet shell 302 having a brim 304. The brim includes through holes at 306 through which extending portions of an anchor can pass before being received by a mounting portion and secured by a locking slider.

Figure 4:
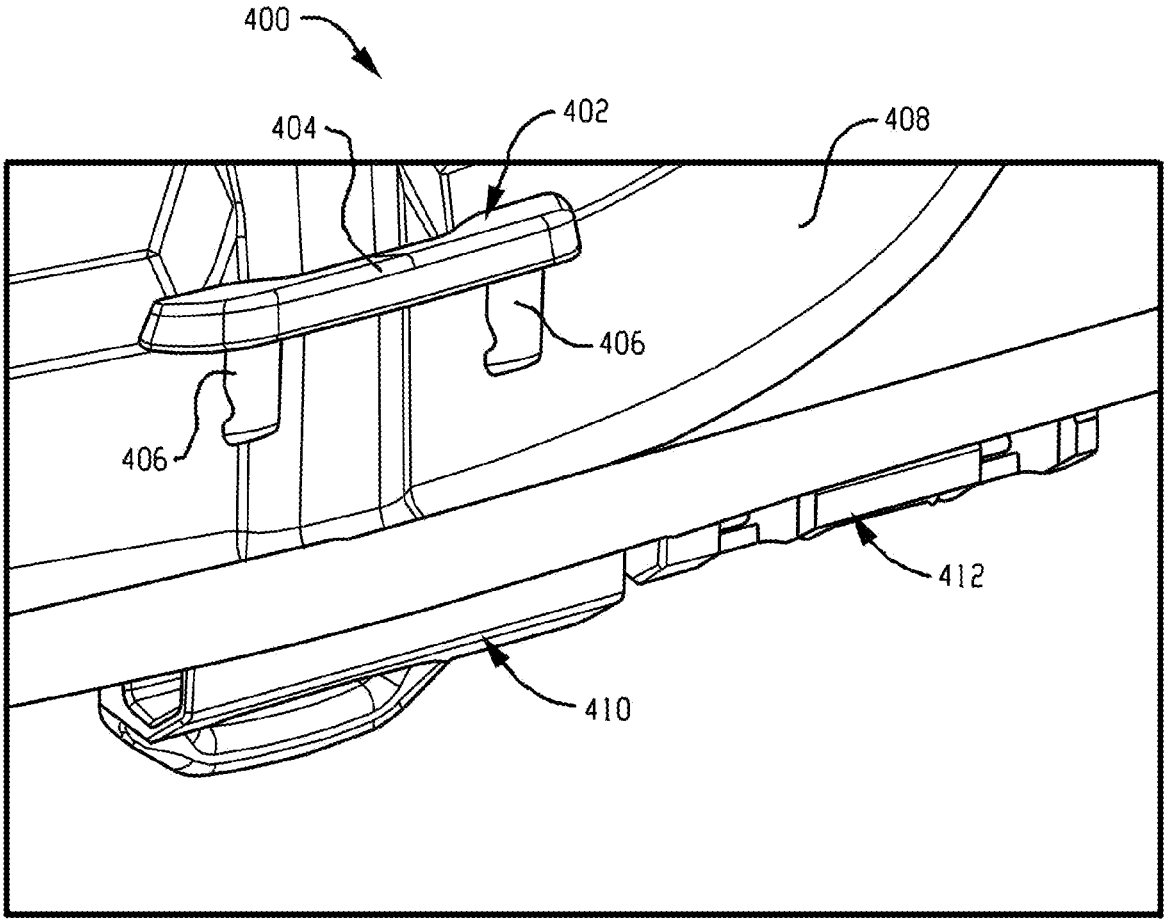
FIG. 4 is a diagram depicting a close up view of an anchor, a mounting portion, and a locking slider.

FIG. 4 is a diagram depicting a close up view of an anchor, a mounting portion, and a locking slider. That embodiment 400 includes an anchor 402. The anchor 402 includes a retention portion 404 and extending portions 406 in the form of two hook shaped structures. The retention portion 404 is larger than the through holes (not shown) in the outer helmet shell 408 through which the extending portions 406 are designed to traverse. The retention portion 402 is configured to reside on one side of the through holes while the extending portions 406 are configured to extend through the through holes, where they are received by the mounting portion 410 and retained therein by the locking slider 412 when the locking slider is moved from the disengaged position depicted in FIG. 4 to an engaged position.

Figure 5:
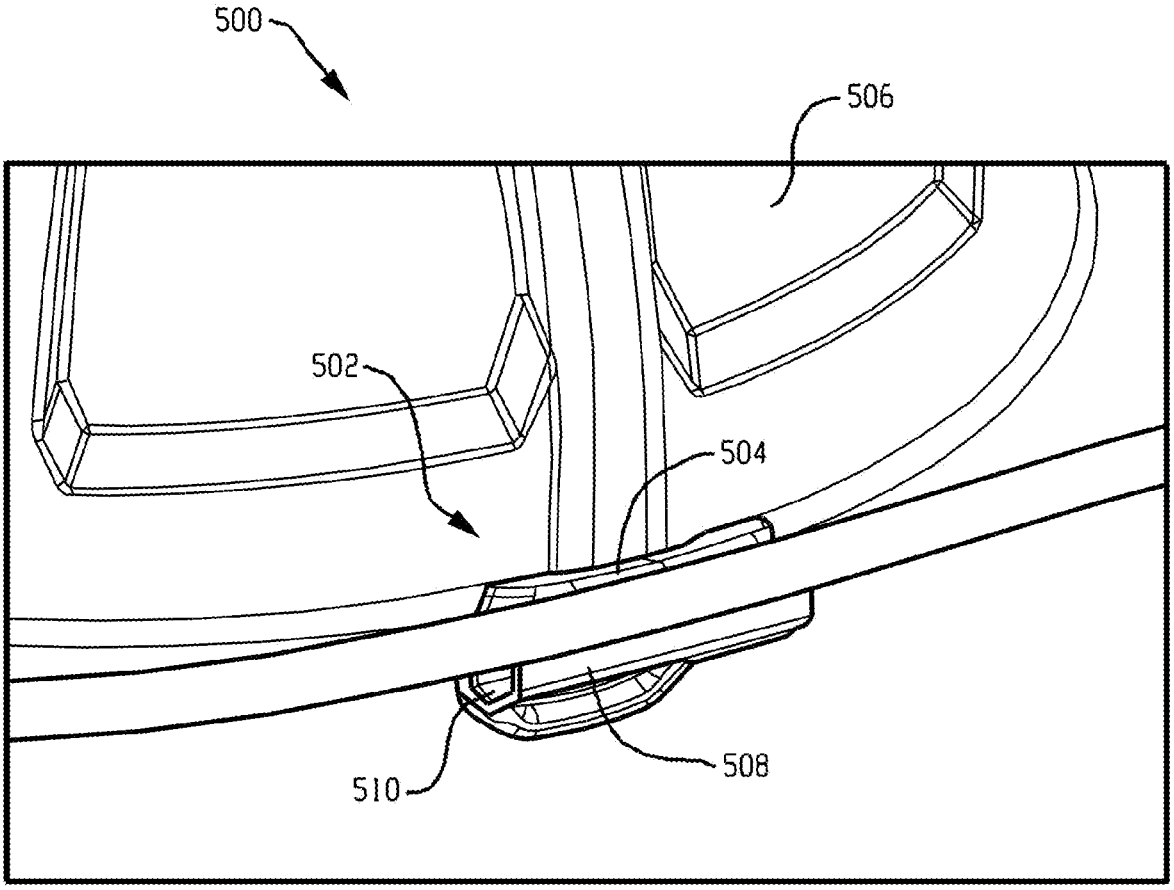
FIG. 5 is a diagram depicting the locking slider in the engaged position.

FIG. 5 depicts the locking slider in the engaged position. In the example 500, an anchor 502, where a retention portion 504 is visible, is in position such that extending portions (not visible) of the anchor extend through through holes of an outer helmet shell 506 into a mounting portion 508 of an inner helmet. A locking slider 510 interfaces with the mounting component 508 in the engaged position shown in FIG. 5 to secure the outer helmet shell 506 to the inner helmet.

Figure 6:
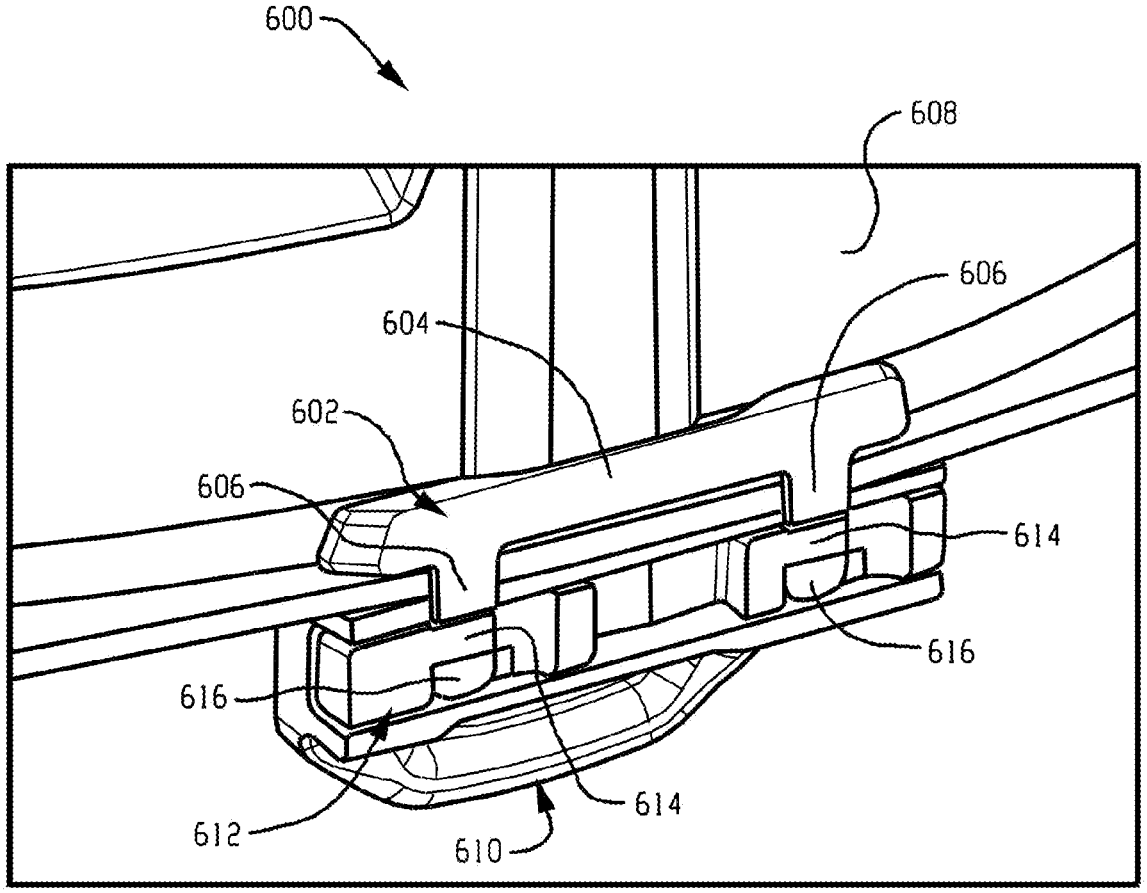
FIG. 6 is a diagram showing a cutaway view of a mounting assembly where a locking slider is in an engaged position.

FIG. 6 is a diagram showing a cutaway view of a mounting assembly where a locking slider is in an engaged position. The example 600 depicts an anchor 602 having a retention portion 604 and two extending portions 606 in the form of hooks that extend through holes of an outer helmet shell 608 where they are received by a mounting component 610 of an inner helmet. A locking slider 612, in the form of a transverse locking slider that substantially spans a width of the mounting component 610, is depicted in an engaged position. When in the engaged position, a portion of the locking slider 612 at 614 sits above a lower portion 616 of the hooks to prevent the hooks from being pulled back up through the through holes of the outer helmet shell.

Figure 7:
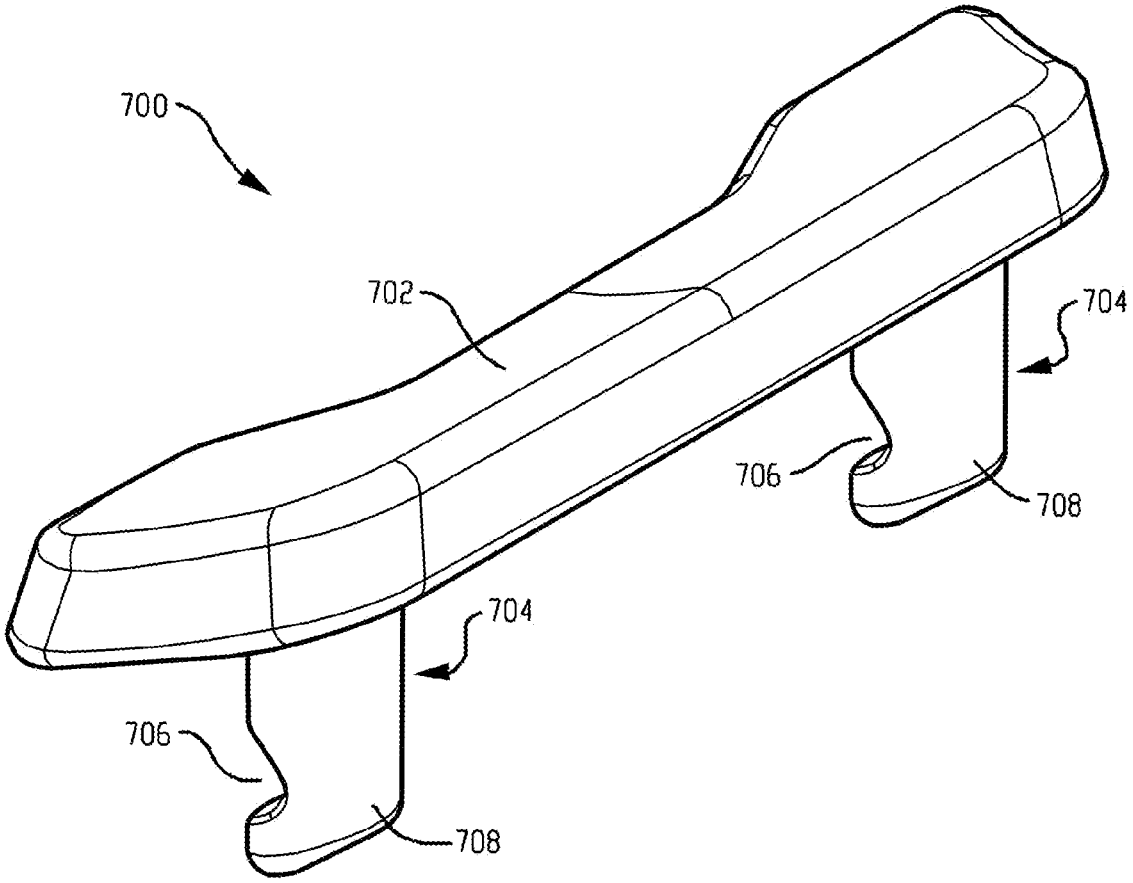
FIG. 7 is a diagram depicting an example anchor.

FIG. 7 is a diagram depicting an example anchor. The anchor 700 includes a retention portion 702 that is sized larger than through holes of the outer helmet shell such that the retention portion 702 is configured to reside on one side of the through hole while extending portions 704, in the form of hooks, are configured to extend through the through holes for retention by a locking slider once received by the mounting portion. The extending portions 704 of FIG. 7 take the form of hooks, where notches at 706 are configured to allow passage of a portion of a locking slider 612 to pass through the notches 706 and over lower portions 708 of the hook extending portions, so as to limit an ability to extract the hooks from the mounting portion when the locking slider is in the engaged position.

Figure 8:
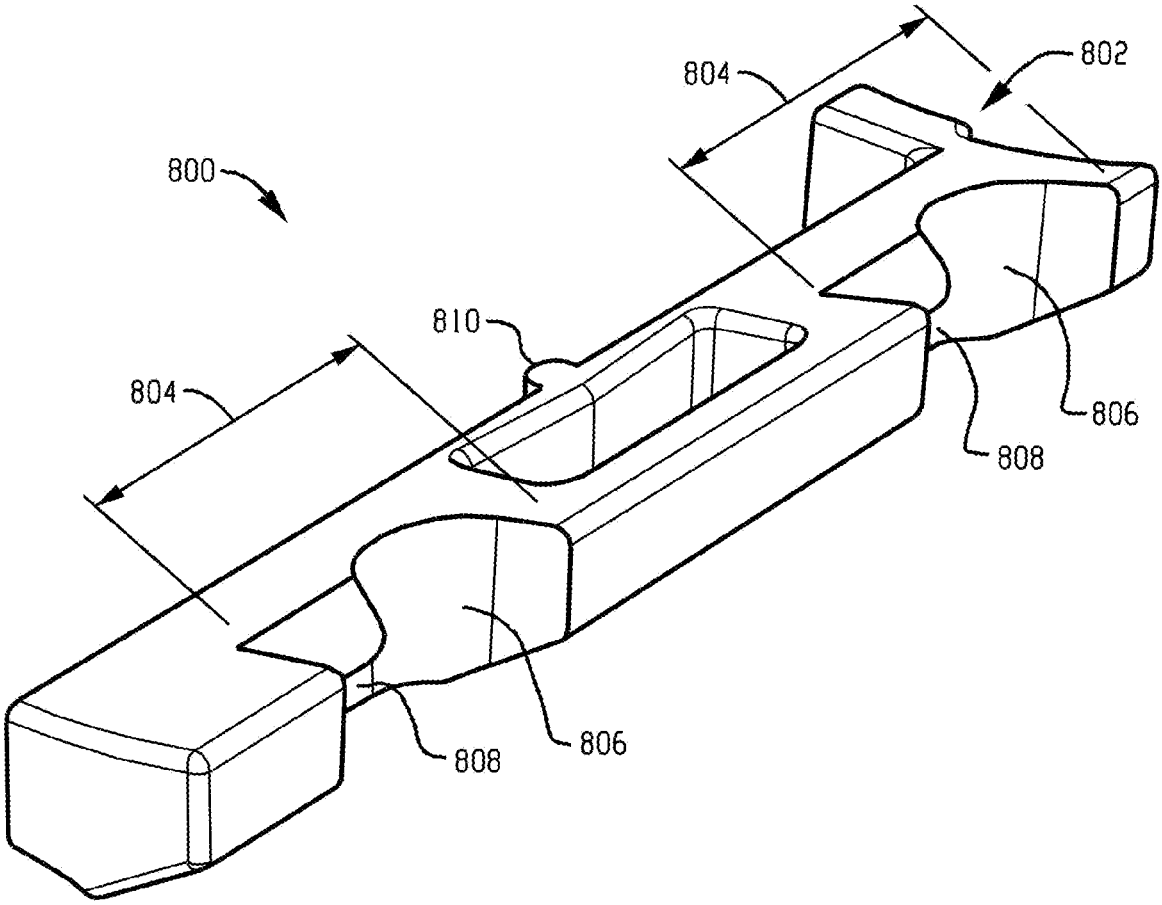
FIG. 8 is a diagram depicting an example locking slider.

FIG. 8 is a diagram depicting an example locking slider. The locking slider 800 includes a handling portion 802 that includes an outer, end surface for pushing the locking slider 800 into an engaged position, having a width amendable to gripping by fingers to facilitate pulling the locking slider 800 from the engaged position. The locking slider 800 includes anchor trapping regions 804. The anchor trapping regions 804 include recesses 806 that are configured to partial surround an upper portion of the extending portion hook of an anchor (e.g., surround or partially surround the notch portions 706 depicted in FIG. 7). The anchor trapping regions 804 further include a retention surface 808 that is configured to be positioned above a lower portion of the hooks so as to limit an ability to extract the hook from the mounting portion when the locking slider is in the engaged position (e.g., as shown in FIG. 6, where element 614 holds lower portion 616 of the hook in place). The locking slider 800 further includes a mechanism (e.g., a protuberance 810 in FIG. 8 a notch) configured to interface with the mounting portion to hold the locking slider in the engaged position until the locking slider is subjected to more than a threshold force to disengage the locking slider. The locking slider may take a variety of forms, which may differ from that illustrated in FIG. 8. For example, the locking slider may include a locking mechanism that prevents the slider from being moved from the engaged position without the use of a tool (e.g., a tab that snaps into place once the locking slider passes a pre-determined point in the mounting portion). In other examples, the locking slider may include a feature (e.g., a knob) that makes it easier to move to a disengaged position. Different use cases may be best served by different locking sliders having features tailored to making the locking slider easier or more difficult to move to/from the engaged position.

As described above, certain systems and methods as described herein may be configured to provide separation of a helmet outer shell from an inner helmet when the helmet is subjected to certain forces of more than a threshold amount. This can be accomplished by providing certain weak points in one or more of an anchor, a mounting assembly, a locking slider, or other component of a helmet, where that weak point is configured to fail at or beyond a predetermined threshold level of force. For example, a mounting assembly may be configured to provide separation of the outer helmet shell from the inner helmet when the mounting assembly is subjected to greater than a threshold tensile load. As an example, the mounting assembly may include a weak point (e.g., a weak point at notch 706 of the anchor of FIG. 7, that weak point being configured to fracture when subjected to a pre-determined force based on a width at the notch 706 or perforations, micro-holes, or other weakening of the notch 706), where the weak point is configured to fracture when subjected to at least the threshold tensile load.

Figure 9:
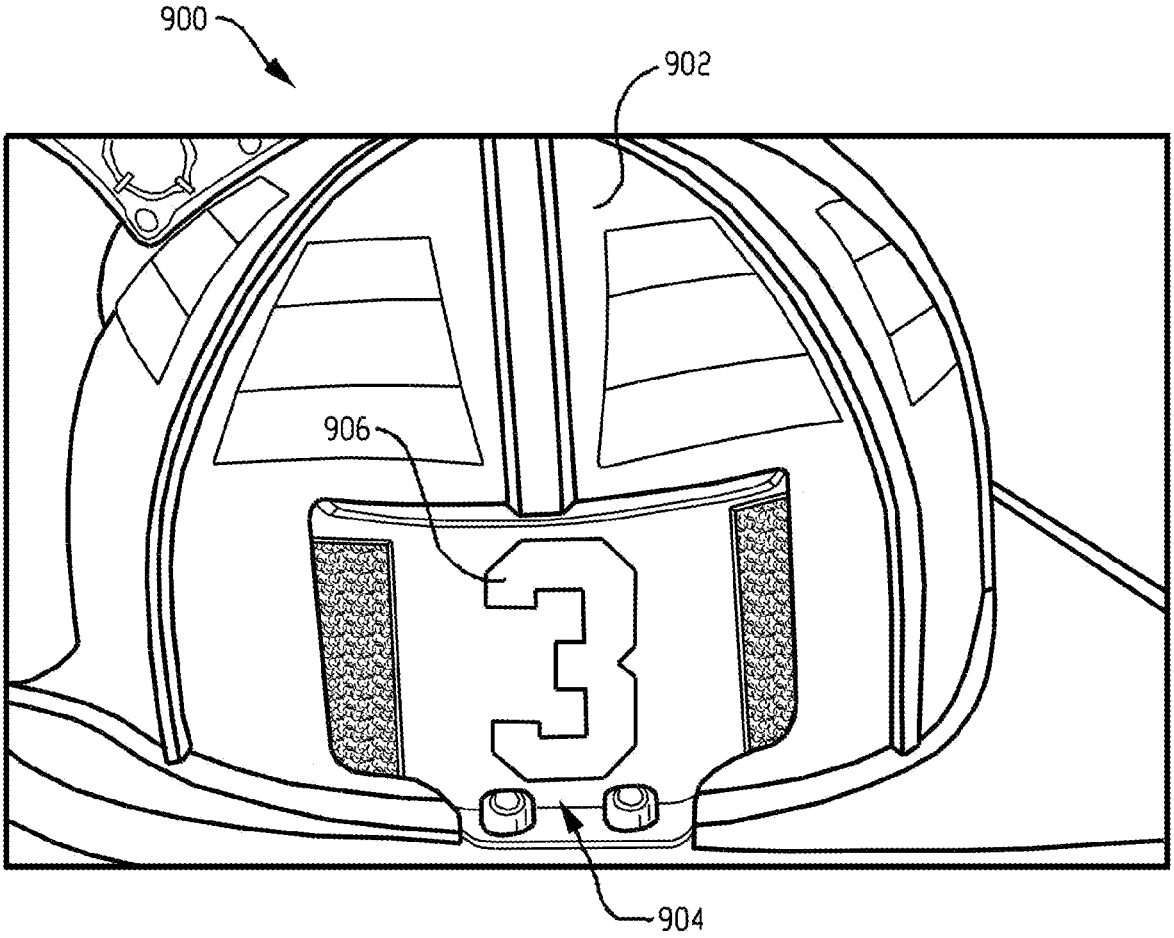
FIG. 9 is a diagram depicting a helmet that includes an accessory integrated with an anchor.

In addition to providing a mechanism for securing an outer helmet shell to an inner helmet, the anchor or other structures of a mounting assembly may provide other functionality as well. For example, an assembly may include an accessory mount connected to the retention portion of the anchor, where the accessory mount comprises a connector for interfacing with a helmet accessory such that the helmet accessory is retained in position on an outside portion of the outer helmet shell. An accessory may take a variety of forms, such as an equipment identifier, a badge, a light, a radio, a sensor, and a GPS device. FIG. 9 is a diagram depicting a helmet that includes an accessory integrated with an anchor. In the example 900, an outer helmet shell 902 is connected to an inner helmet via an anchor 904. Integrated with the anchor is an accessory 906 in the form of an equipment/personnel identifier, indicating equipment or operator #3. An accessory 906 may be integrated with the anchor 904 at its retention portion as shown in FIG. 9, or the accessory may connect with a mount that is connected to or integrated with the anchor, promoting incorporation of approved accessories with a helmet while discouraging use of unapproved accessories that are not designed to be connected thereto. In embodiments, different accessories can be attached and detached as desired by a wearer.

Figure 10:
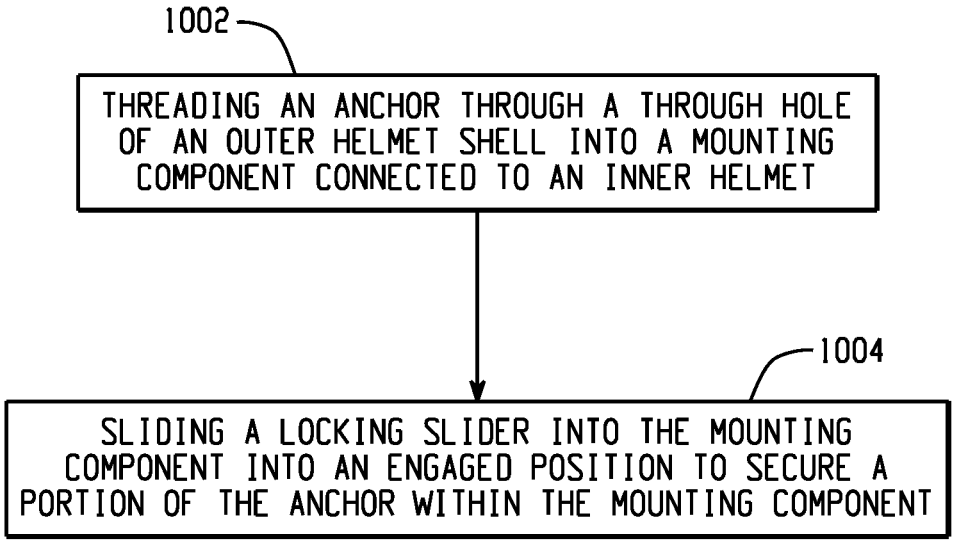
FIG. 10 is a flow diagram depicting a method of interfacing an outer helmet shell to an inner helmet.

FIG. 10 is a flow diagram depicting a method of interfacing an outer helmet shell to an inner helmet. The method includes threading an anchor through a through hole of an outer helmet shell into a mounting component connected to an inner helmet at 1002. At 1004, a locking slider is slid into the mounting component into an engaged position to secure a portion of the anchor within the mounting component.

Systems and methods as described herein may take a variety of forms. In one example, systems and methods are provided for a helmet shell mounting assembly. A system includes a mounting component and a locking slider configured to interface with the mounting component when in an engaged position to secure an outer helmet shell to an inner helmet.

Systems and methods may include one or more of the following additional features, alone or in combination with one another. For example, the mounting assembly may be configured to provide separation of the outer helmet shell and the inner helmet when the mounting assembly is subjected to greater than a threshold tensile load. The mounting assembly may include a weak point, wherein the weak point is configured to fracture when subjected to at least the threshold tensile load. The outer helmet shell may be configured to be removed from the inner helmet when the weak point is fractured or when the locking slider is moved to a disengaged position. The locking slider may include a transverse locking slider that is configured to substantially span a width of the mounting component when the locking slider is in the engaged position. The mounting component may include a channel configured to receive the locking slider when the locking slider is in the engaged position. The assembly may include a retention mechanism for retaining the locking slider at or near the mounting component when the locking slider is in a disengaged position. The assembly may include an anchor, where an extending portion of the anchor is configured to pass through the outer helmet shell via a through hole, where the extending portion of the anchor is configured to be received by the mounting portion, and where the locking slider is configured to retain the extending portion of the anchor within the mounting portion when in the engaged position. The anchor may include the extending portion of the anchor, and a retention portion, where the retention portion is larger than the through hole such that the retention portion is configured to reside on one side of the through hole while the extending portion is configured to extend through the through hole for retention by the locking slider once received by the mounting portion. The extending portion may include a plurality of hooks. The locking slider may include an anchor trapping region, where the anchor trapping region includes a recess configured to partially surround an upper portion of the hook and a retention surface configured to be positioned above a lower portion of the hook so as to limit an ability to extract the hook from the mounting portion when the locking slider is in the engaged position. The assembly may include an accessory mount connected to the retention portion of the anchor, where the accessory mount comprises a connector for interfacing with a helmet accessory such that the helmet accessory is retained in position on an outside portion of the outer helmet shell. The accessory may include one or more of: a user or equipment identifier, a badge, a light, a radio, a sensor, a GPS device, ear protection, a visor, and a face shield. The assembly may comprise an accessory connected to the retention portion of the anchor. The locking slider may include a notch or a protuberance configured to interface with the mounting portion to hold the locking slider in the engaged position until the locking slider is subjected to more than a threshold force to disengage the locking slider. The outer helmet shell may include a full brim fire helmet, a full brim construction helmet, or a cap style construction helmet. The inner helmet may include an inner portion that is configured to conform to a head of a user, where the inner helmet further comprises an outer portion that comprises a shock absorbing material. The mounting component may be permanently attached to the inner helmet.

In another example, a method of interfacing an outer helmet shell to an inner helmet includes threading an anchor through a through hole of an outer helmet shell into a mounting component connected to an inner helmet. A locking slider is slid into the mounting component into an engaged position to secure a portion of the anchor within the mounting component.

In an example, the outer helmet shell is disengaged from the inner helmet by either: sliding the locking slider into a disengaged position such that the anchor can be removed from the mounting component; or subjecting one of the mounting assembly, the locking slider, and the anchor to more than a predefined tensile load to induce a fracture of said one of the mounting assembly, the locking slider, and the anchor.

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

It is claimed:

1. A helmet assembly comprising:

an outer helmet shell;

an inner helmet; and a mounting assembly, the mounting assembly comprising:

a mounting component integrated with the inner helmet;

an anchor having extending portions configured to extend through the outer helmet shell and into the mounting component; and a locking slider configured to slide into the mounting component when the locking slider is in an engaged position and slide out of the mounting component when the locking slider is in a disengaged position;

wherein when the locking slider is in the engaged position, the locking slider is configured to secure the outer helmet shell to the inner helmet; and wherein when the locking slider is in the disengaged position, the outer helmet shell is removable from the inner helmet and the mounting component, and the extending portions are removable from the mounting component.

2. The helmet assembly of claim 1, wherein the mounting assembly is configured to provide separation of the outer helmet shell and the inner helmet when the mounting assembly is subjected to greater than a threshold tensile load.

3. The helmet assembly of claim 2, wherein at least one of the mounting component, the anchor, or the locking slider is configured to fracture at a weak point when subjected to at least the threshold tensile load.

4. The helmet assembly of claim 1, wherein the locking slider comprises a transverse locking slider that is configured to substantially span a width of the mounting component when the locking slider is in the engaged position.

5. The helmet assembly of claim 4, wherein the mounting component comprises a channel configured to receive the locking slider when the locking slider is in the engaged position.

6. The helmet assembly of claim 5, wherein the locking slider is configured to catch on a surface within the channel such that the locking slider is retained in the channel.

7. The helmet assembly of claim 1, wherein the outer helmet shell comprises through holes, wherein the extending portions of the anchor are configured to pass through the outer helmet shell via the through holes, wherein the extending portions of the anchor are configured to be received by the mounting component, and wherein the locking slider is configured to retain the extending portions of the anchor within the mounting component when in the engaged position.

8. The helmet assembly of claim 7, wherein the anchor further comprises:

a retention portion;

wherein the retention portion is larger than the through holes such that the retention portion is configured to reside on one side of the through holes while the extending portions are configured to extend through the through holes for retention by the locking slider once received by the mounting component.

9. The helmet assembly of claim 8, wherein the extending portions comprise a plurality of hooks.

10. The helmet assembly of claim 9, wherein the locking slider comprises an anchor trapping region, wherein the anchor trapping region includes a recess configured to partially surround an upper portion of at least one of said plurality of hooks and a retention surface configured to be positioned above a lower portion of said at least one of said plurality of hooks so as to limit an ability to extract said at least one of said plurality of hooks from the mounting component when the locking slider is in the engaged position.

11. The helmet assembly of claim 7, further comprising:

an accessory mount connected to the retention portion of the anchor, wherein the accessory mount comprises a connector for interfacing with a helmet accessory such that the helmet accessory is retained in position on an outside portion of the outer helmet shell.

12. The helmet assembly of claim 11, wherein the helmet accessory comprises one or more of:

a user or equipment identifier, a badge, a light, a radio, a sensor, a GPS device, ear protection, a visor, and a face shield.

13. The helmet assembly of claim 7, further comprising an accessory connected to the retention portion of the anchor.

14. The helmet assembly of claim 1, wherein the locking slider includes a notch or a protuberance configured to interface with the mounting component to hold the locking slider in the engaged position until the locking slider is subjected to more than a threshold force to disengage the locking slider.

15. The helmet assembly of claim 1, wherein the outer helmet shell comprises a full brim fire helmet.

16. The helmet assembly of claim 1, wherein the inner helmet comprises an inner portion that is configured to conform to a head of a user, wherein the inner helmet further comprises an outer portion that comprises a shock absorbing material.

17. The helmet assembly of claim 1, wherein the mounting component is permanently attached to the inner helmet.

18. The helmet assembly of claim 1, wherein the locking slider is configured to be pushed into the engaged position.

* * * * *